US010188901B1

(12) United States Patent
Cassidy

(10) Patent No.: US 10,188,901 B1
(45) Date of Patent: Jan. 29, 2019

(54) TORSO MUSCLE AND SPINE EXERCISE APPARATUS

(71) Applicant: Daniel T. Cassidy, Ashland, OR (US)

(72) Inventor: Daniel T. Cassidy, Ashland, OR (US)

( * ) Notice: Subject to any disclaimer, the term of this patent is extended or adjusted under 35 U.S.C. 154(b) by 143 days.

(21) Appl. No.: 15/410,575

(22) Filed: Jan. 19, 2017

Related U.S. Application Data

(60) Provisional application No. 62/280,375, filed on Jan. 19, 2016.

(51) Int. Cl.

| | |
|---|---|
| ***A63B 21/00*** | (2006.01) |
| ***A63B 21/02*** | (2006.01) |
| ***A63B 22/00*** | (2006.01) |
| ***A63B 23/02*** | (2006.01) |
| ***A63B 21/005*** | (2006.01) |
| ***A63B 21/055*** | (2006.01) |
| ***A63B 21/062*** | (2006.01) |

(52) U.S. Cl.
CPC ..... *A63B 23/0205* (2013.01); *A63B 21/005* (2013.01); *A63B 21/023* (2013.01); *A63B 21/0552* (2013.01); *A63B 21/063* (2015.10); *A63B 21/154* (2013.01); *A63B 21/4009* (2015.10); *A63B 21/4034* (2015.10); *A63B 21/4039* (2015.10); *A63B 21/4049* (2015.10); *A63B 22/0015* (2013.01); *A63B 22/0046* (2013.01); *A63B 2210/50* (2013.01)

(58) Field of Classification Search
CPC ..... A63B 23/0205; A63B 21/4009; A63B 22/0015; A63B 21/4049; A63B 21/4039; A63B 21/4034; A63B 22/0046; A63B 21/0552; A63B 21/023; A63B 21/005; A63B 21/154; A63B 21/063; A63B 2210/50
See application file for complete search history.

(56) References Cited

U.S. PATENT DOCUMENTS

| | | | | |
|---|---|---|---|---|
| 4,296,924 A * | 10/1981 | Anzaldua | A63B 23/0211 482/139 |
| 4,515,363 A * | 5/1985 | Schleffendorf | A63B 21/155 482/100 |
| 5,498,221 A * | 3/1996 | Blair, Jr. | A63B 23/03575 482/139 |
| 5,941,807 A | 8/1999 | Cassidy et al. | |
| 6,368,296 B1 | 4/2002 | Eiter et al. | |
| 9,616,274 B2 * | 4/2017 | Wehrell | A61H 1/0229 |

OTHER PUBLICATIONS

Daniel T. Cassidy, AB & Back Core Trainer, 2003 brochure.

* cited by examiner

*Primary Examiner* — Sundhara M Ganesan
(74) *Attorney, Agent, or Firm* — Procopio Cory Hargreaves and Savitch LLP

(57) ABSTRACT

An exercise apparatus comprising a base; a supporting surface carried by the base, the supporting surface to receive a weight bearing portion of a user's body; a support frame carried by the base; a stationary pelvic belt receiving frame carried by the support frame; a pelvic belt rotatably received within the stationary pelvic belt receiving frame and configured to securely receive a pelvic area of the user's body for rotation therewith; and one or more mechanical force resistors carried by the support frame and operably coupled to the pelvic belt so as to impart resistance to rotation of the pelvic belt relative to the stationary pelvic belt receiving frame.

19 Claims, 13 Drawing Sheets

TORSO MUSCLE AND SPINE EXERCISE APPARATUS

CROSS REFERENCE TO RELATED APPLICATION

This application claims the benefit of prior provisional patent application No. 62/280,375, filed Jan. 19, 2016, which is incorporated by reference herein.

BACKGROUND

Field of the Invention

The invention relates to an exercise device, and more specifically to a device for exercising the spinal column and the muscles of the torso, including those in the abdominal, lumbar and thoracic regions.

Related Art

The human torso has many muscles that are oriented at various angles from their attachment to the pelvis. In order to exercise these muscles, or assist in rehabilitation of injured muscles, it is necessary to use a machine like that shown in Applicant's U.S. Pat. No. 5,941,807 for a Torso Muscle And Spine Exercise Apparatus, which is incorporated by reference herein. This machine uses rotating resistance to strengthen torso muscles.

When a person wishes to use the Torso Muscle And Spine Exercise Apparatus, he must first firmly attach the belt to his pelvic region. Cables extend from different points on the belt to one or more weight stacks. The person rotates his pelvic region relative to other parts of the body and against the resistance created by lifting the weights in the weight stacks.

Because Applicant noticed that it took a significant amount of time to attach, adjust and, subsequent to use, remove the belt shown in the patent and there was often more than the tolerated amount of relative movement between the belt and the person wearing it, Applicant developed a pelvic belt that can be quickly and conveniently attached and detached from the pelvic region, and that also firmly mounts to the person's pelvic region. Applicant's Belt Apparatus For Human Pelvis shown and described in U.S. Pat. No. 6,368,296, which is incorporated by reference herein, is a pelvic belt for firmly gripping a human torso near the pelvic region. The pelvic belt includes three main components: a U-shaped frame with left and right frame legs, a left arm assembly pivotally mounted to the left frame leg, and a right arm assembly pivotally mounted to the right frame leg. Each arm assembly has four main sub-components: an upper arm, a lower arm, a connecting rod connecting the upper and lower arms rigidly together and an adjustment wing for adjusting the dimensions of the interior region of the pelvic belt. The left and right arm assemblies pivot about pivot pins mounting the arm assemblies to the U-shaped frame. This permits a person to enter the interior region of the pelvic belt when the arm assemblies are pivoted open, and then the arm assemblies are pivoted to a closed position. The pelvic belt can be attached to force resisting mechanisms to build strength over time.

Applicant has recognized a need for a torso muscle and spine exercise apparatus that combines the advantageous features of Applicant's Belt Apparatus For Human Pelvis shown and described in U.S. Pat. No. 6,368,296 and Applicant's Torso Muscle And Spine Exercise Apparatus shown and described in U.S. Pat. No. 5,941,807, and adds further improvements.

SUMMARY

An aspect of the invention involves an exercise apparatus comprising a base; a supporting surface carried by the base, the supporting surface to receive a weight bearing portion of a user's body; a support frame carried by the base; a stationary pelvic belt receiving frame carried by the support frame; a pelvic belt rotatably received within the stationary pelvic belt receiving frame and configured to securely receive a pelvic area of the user's body for rotation therewith; and one or more mechanical force resistors carried by the support frame and operably coupled to the pelvic belt so as to impart resistance to rotation of the pelvic belt relative to the stationary pelvic belt receiving frame.

One or more implementations of the aspect of the invention described immediately above includes one or more of the following: the one or more mechanical force resistors include one of one of one or more weight stacks, one of one or more conventional coil springs, one of one or more elastomeric bands, one of one or more fluid springs, and one of one or more electromagnets; the exercise apparatus includes a front, and the one or more mechanical force resistors is a single weight stack system centered laterally at the front of the exercise apparatus, directly in front of where the user using the apparatus would stand on the supporting surface; the single weight stack system includes a plurality of stacked weights and a weight stack cable coupled at one end to the stacked weights and coupled at an opposite end to the pelvic belt whereby rotation of the pelvic belt relative to the stationary pelvic belt receiving frame causes the coupled weights to raise and lower, depending on a direction of rotation and a degree of rotation; the stationary pelvic belt receiving frame includes a front quadrant, a plurality of pulleys are disposed in the front quadrant, and the weight stack cable runs through the plurality of pulleys whereby rotation of the pelvic belt relative to the stationary pelvic belt receiving frame causes the coupled weights to raise and lower; the plurality of pulleys include a pair of adjacent horizontally disposed pulleys and a vertically disposed pulley disposed in a front central portion of the stationary pelvic belt receiving frame, and the weight stack cable runs laterally outward from the pelvic belt, through the horizontally disposed pulleys, and vertically downward through the vertically disposed pulley to the coupled weights; the pelvic belt includes left, central, and right arcuate roller support frame members that carry rollers, and the stationary pelvic belt receiving frame includes a roller receiving surface that the rollers of the pelvic belt engage to enable rotation of the pelvic belt relative to the stationary pelvic belt receiving frame; the left arcuate roller support frame member and the central arcuate roller support frame member include opposing curved ends with a gap there between that the weight stack cable extends through, and rotation of the pelvic belt in a first range causes the weight stack cable to slide along one of the opposing curved ends and rotation of the pelvic belt in a second range causes the weight stack cable to slide along an opposing one of the opposing curved ends; the pelvic belt includes a front interior and a rear interior, and the front interior includes one or more abdominal pads and the rear interior includes a pair of adjustable wings with pads thereon to secure a user's pelvic area on the pelvic belt; the pair of adjustable wings are pivotally coupled to the pelvic belt, and an adjustable wing control is operably coupled to the pair of adjustable wings to selectively adjust pivotal positioning of the pair of adjustable wings; the pelvic belt includes pulleys and a wing control cable running through the pulleys, the wing control cable operably coupling the adjustable wing control to the pair of adjustable wings through the pulleys to selectively adjust pivotal positioning of the pair of adjustable wings; the adjustable wing control includes a wing control rotatable base that the wing control cable is disposed within whereby rotation of the wing control rotatable base caused by operation of the adjustable wing control causes an effective length of the wing control cable to shorten or lengthen, depending on direction of rotation of the wing control rotatable base, causing the pair of adjustable wings to close or open; the pelvic belt includes a stationary adjustment member with position settings and the adjustable wing control is positionable in the position settings for positioning and locking the adjustable wings in a desired position; the wing control cable is disposed in a serpentine configuration in the wing control rotatable base at a portion of the wing control cable offset from center; a rotatable standing support to support a user feet for rotation therewith, the one or more mechanical force resistors operably coupled to the rotatable standing support so as to impart resistance to rotation of the rotatable standing support; in an operational configuration the stationary pelvic belt receiving frame, the pelvic belt, and the base are horizontally disposed and the support frame is vertically disposed, and in a collapsed/folded configuration the pelvic belt receiving frame, the pelvic belt, the base, and the support frame are vertically disposed; the pelvic belt receiving frame is pivotally coupled to the support frame, the base is a collapsible/foldable base including front and rear base members that are pivotally coupled to each other, and in the collapsed/folded configuration, the pelvic belt receiving frame is pivoted downward with respect to the support frame, and the rear base member is pivoted upward with respect to the front base member; the pelvic belt includes a front interior and a rear interior, and the front interior includes one or more abdominal pads and the rear interior includes a pair of adjustable wings with pads thereon to secure a user's pelvic area on the pelvic belt, the pair of adjustable wings are pivotally coupled to the pelvic belt so as to pivot inward, adjacent to, and substantially parallel with the left and right abdominal pads; a collapsible/foldable rotatable standing support to support a user's feet for rotation therewith, the one or more mechanical force resistors operably coupled to the rotatable standing support so as to impart resistance to rotation of the rotatable standing support, the rotatable standing support including front and rear semi-circular members that are pivotally coupled to each other so as pivot onto each other to collapse/fold the rotatable standing support, and in the collapsed/folded configuration, the rear base member and the collapsible/foldable rotatable standing support are pivoted upward with respect to the front base member; the support frame includes a pair of vertical support columns with height adjustment holes, a spring-loaded height adjustment mechanism that cooperates with the height adjustment holes, and a pair of gas-charged struts that counter-balance the weight of the stationary pelvic belt receiving frame and the support frame to easily lower and raise the pair of vertical support columns to a desirable height for a user; and/or a rotation limiter having a vertically adjustable rotation limiter movable member and a rotation limiter adjustment mechanism that cooperates with the vertically adjustable rotation limiter movable member to adjust a vertical position of the vertically adjustable rotation limiter movable member, which is operably associated with the one or more mechanical force resistors to limit maximum degrees of rotation clockwise and counterclockwise by the pelvic belt.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Figure 1:
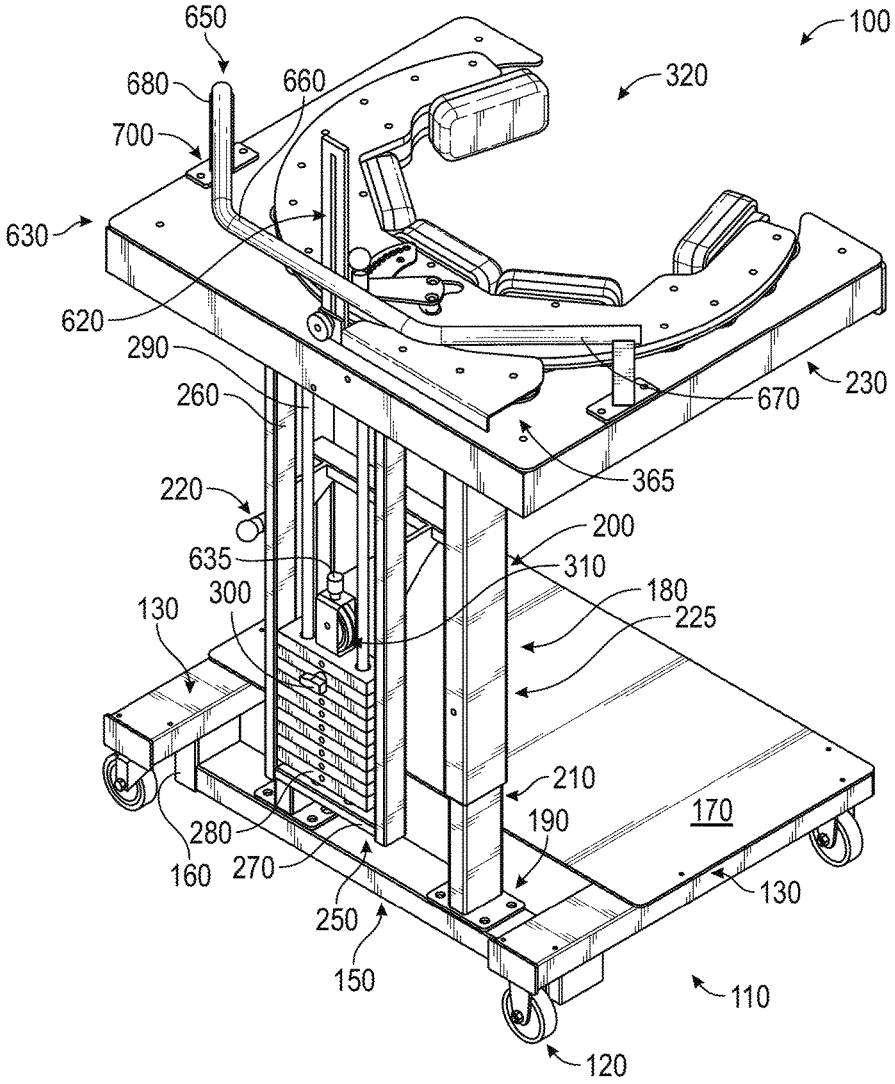
FIG. 1 is a perspective view of an embodiment of a torso muscle and spine exercise apparatus.

With reference to FIGS. 1-7, an embodiment of a torso muscle and spine exercise apparatus ("apparatus") 100 will be described. The apparatus 100 includes a base 110 supported on wheels 120. The base 110 includes a pair of opposite longitudinal base support rails 130, a rear lateral base support rail 140, and a front lateral base support rail 150, which is connected at opposite ends to an underside of the pair of opposite longitudinal base support rails 130 by short vertical connection rails 160. A stationary standing plate 170 functions as a supporting surface to receive a weight bearing portion of a user's body and is supported on the pair of opposite longitudinal base support rails 130 and the rear lateral base support rail 140.

Figure 4:
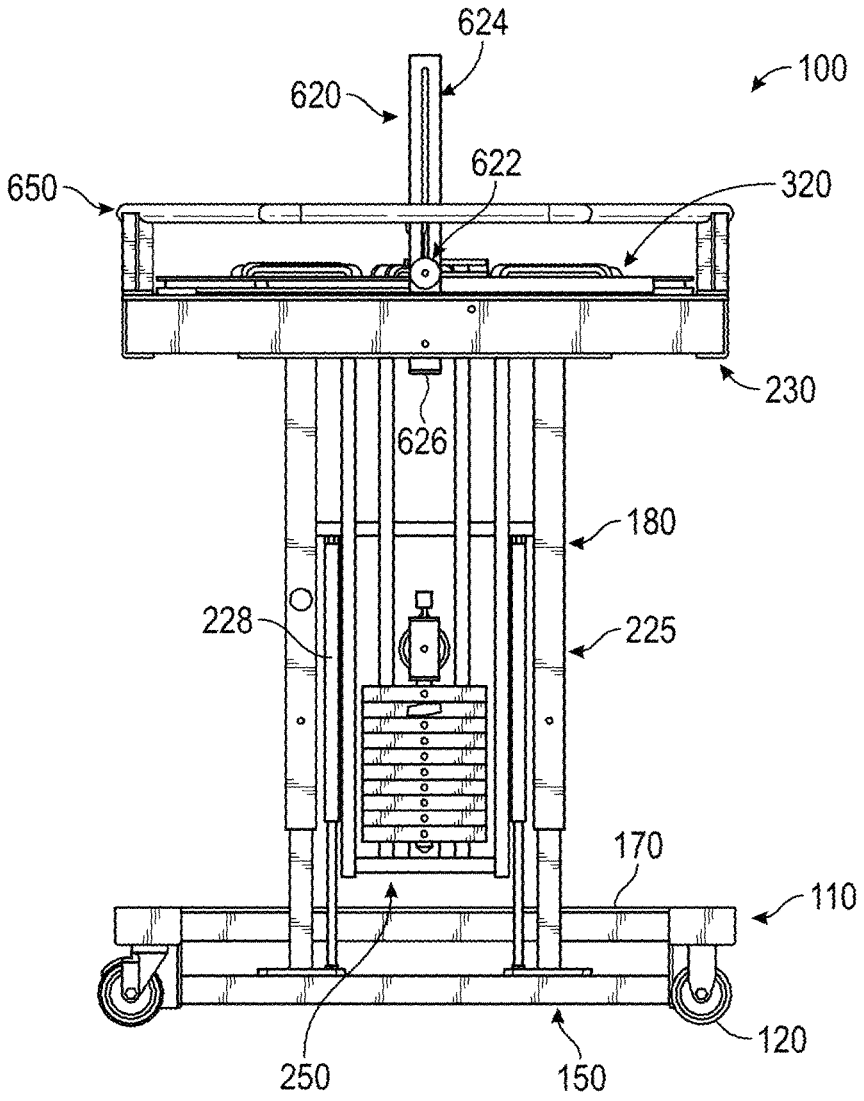
FIG. 4 is a front elevational view of the torso muscle and spine exercise apparatus of FIG. 1.
Figure 5:
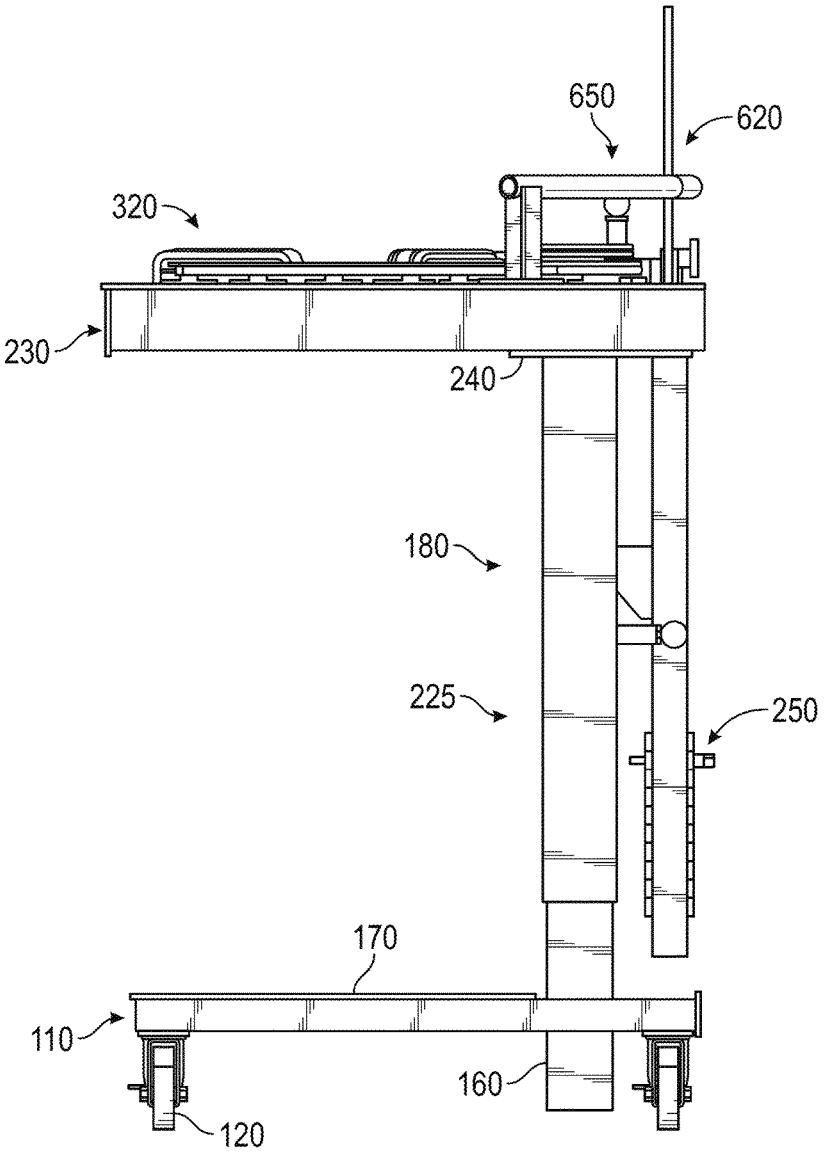
FIG. 5 is right side-elevational view of the torso muscle and spine exercise apparatus of FIG. 1.
Figure 6A:
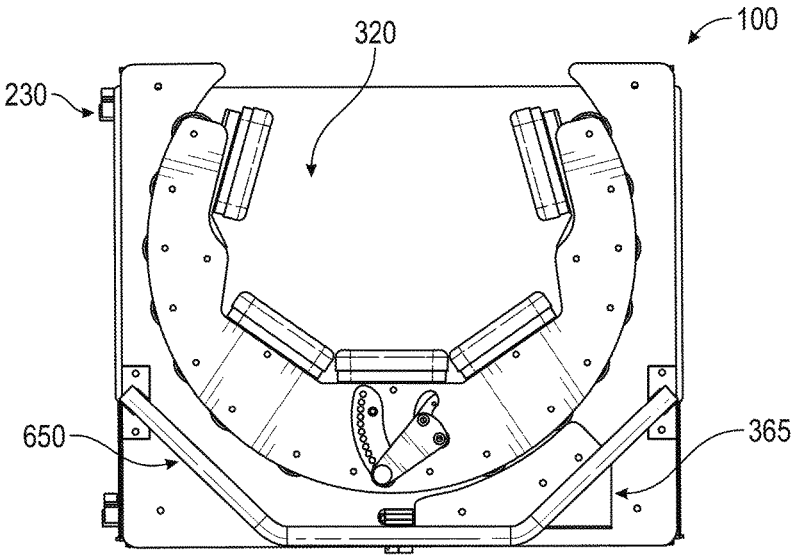
FIG. 6A is a top plan view of the torso muscle and spine exercise apparatus of FIG. 1.
Figure 6B:
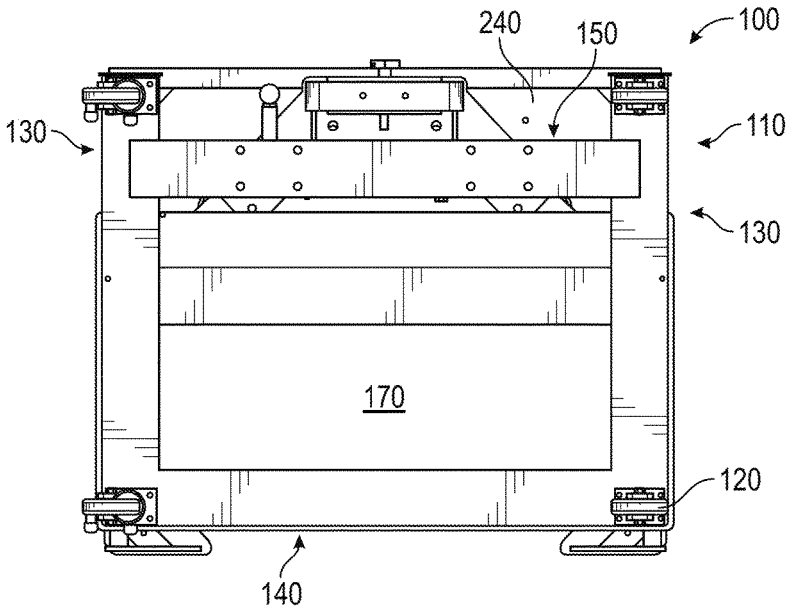
FIG. 6B is a bottom plan view of the torso muscle and spine exercise apparatus of FIG. 1.

A pair of vertical support columns 180 are mountable supported on the front lateral base support rail 150 via brackets 190 and fasteners. The vertical support columns 180 include upper support members 200 slidably disposed over lower support members 210 for adjusting a height of the apparatus 100 via spring-loaded pull knob 220 and receiving holes in the lower support members 210. The pair of vertical support columns 180 form a support frame 225. As best shown in FIG. 4, gas-charged struts/springs 228 counter-balance the weight of the upper structure of the machine so one can easily adjust the height of the apparatus 100 to a desirable height for each user.

A stationary pelvic belt receiving frame 230 is supported via a support plate 240 by the support frame. A single weight stack system 250 hangs from a front of the support plate 240. The single weight stack system 250 is centered laterally at front of the apparatus 100, directly in front of where a user using the apparatus would stand on the standing plate 170. The single weight stack system 250 includes outer vertical supports 260 and lateral bottom support 270. A single stack of weights 280 are supported in a gap between the outer vertical supports 260 by the lateral bottom support 270. The weights 280 shown are rectangular plates with a pair of vertically disposed holes therein that receive a pair of vertical pick up bars 290 that the weights 280 slide vertically along. A front of the weights 280 include channels that receive a pin 300 that extends into a hole in a weight stack support member 310 that extends through a vertical hole in the center of the weights 280 for adjusting the number of weights 280 lifted in a well-known manner. In alternative embodiments, instead of single weight stack, multiple weight stacks (e.g., 2, 3, 4, etc.) to provide mechanical force resistance and/or other types of mechanical force resistor(s)s may be used other than weight stack(s) such as, but not limited to, spring(s), band(s). For example, the stack of weights 280 may be replaced with one or more springs (e.g., conventional coil spring(s), elastomeric band(s), fluid spring (s), electromagnet(s)) whereby the spring(s) resist upward displacement of cable 330.

Figure 2:
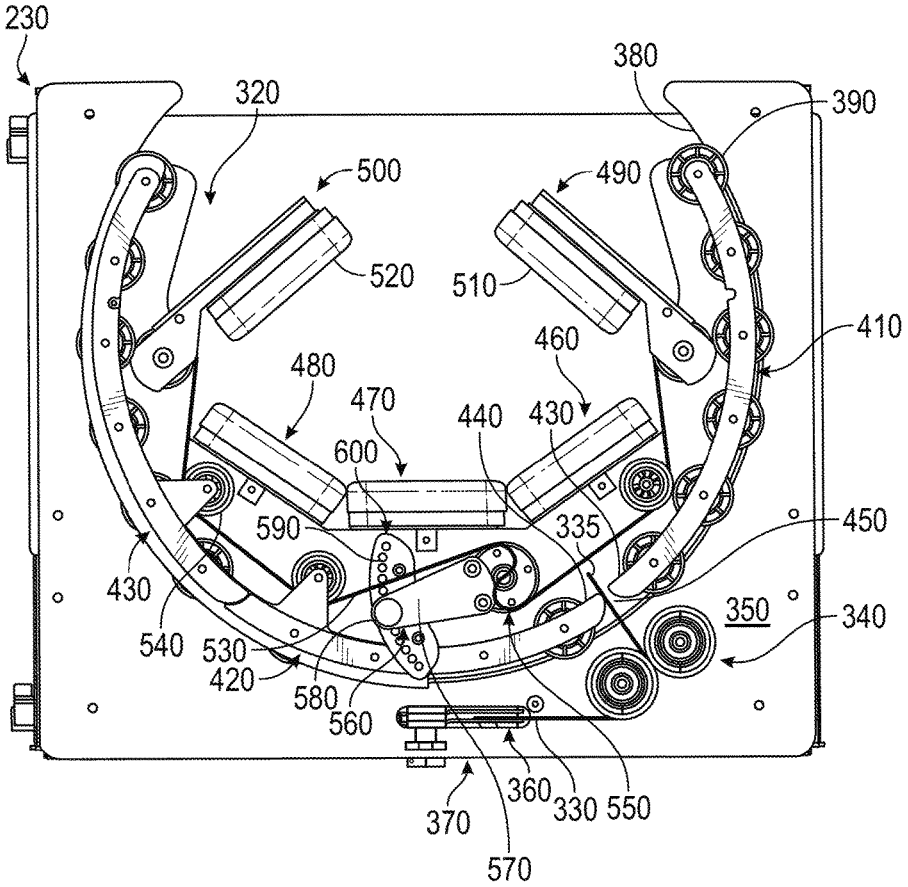
FIG. 2 is a top plan view of an embodiment of a pelvic belt, with a cover of the pelvic belt shown removed, rotatably mounted within a stationary pelvic belt receiving frame.
Figure 3A:
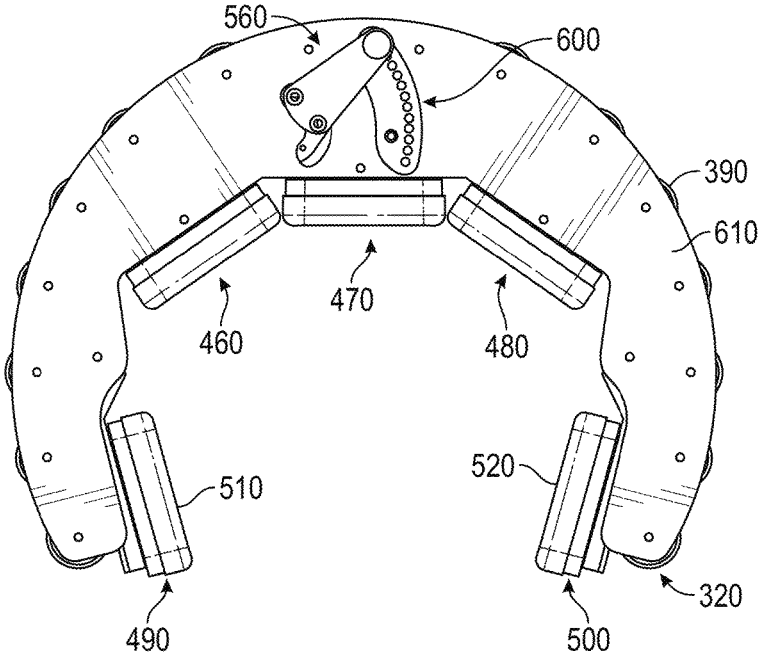
FIG. 3A is a top plan view of an embodiment of a pelvic belt that fits into the torso muscle and spine exercise apparatus of FIG. 1.
Figure 3B:
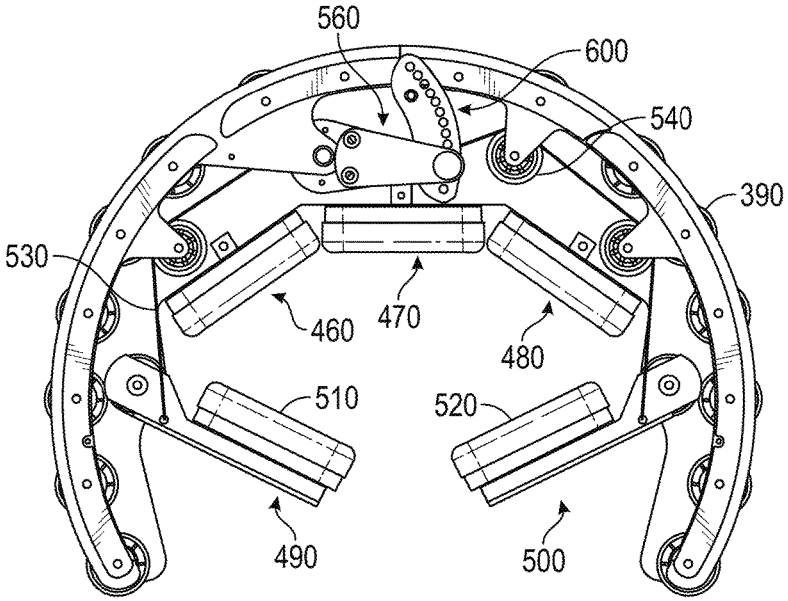
FIG. 3B is a top plan view of the pelvic belt of FIG. 3A, with a cover of the pelvic belt shown removed.

With reference to FIG. 2, a pelvic belt 320 is rotatably mounted within the stationary pelvic belt receiving frame 230. Weight stack cable 330 is coupled at one end to the pelvic belt 320 and coupled at an opposite end to the weight stack support member 310. At a location 335, the cable 330 extends through a hole in a plate (not shown) of the pelvic belt 320. At this end of the cable 330, the cable 330 includes a clevis-style end on it and would attach with a bolt where the cable 330 ends. The cable 330 runs laterally through a pair of horizontally disposed pulleys 340 disposed in a front left corner/quadrant 350 of the stationary pelvic belt receiving frame 230 and vertically down through a vertically disposed pulley 360 disposed in a front central portion 370 of the stationary pelvic belt receiving frame 230 to the weight stack support member 310. Horizontally disposed pulleys 340 have a vertical rotational axis and vertically disposed pulley 360 has a horizontal/lateral rotational axis. A cover 365 (FIG. 1) covers the cable 330, pulleys 340, and pulley 360.

The stationary pelvic belt receiving frame 230 includes circular roller receiving surface(s) 380, which are rollably engaged by rotating rollers 390 of the pelvic belt 320, enabling rotatable movement of the pelvic belt 320 within the stationary pelvic belt receiving frame 230. The rollers 390 are rotatably coupled to left, central, and right arcuate roller support frame members 400, 410, 420. The left arcuate roller support frame member 400 and the central arcuate roller support frame member 410 include opposing curved ends 430, 440 with a gap 450 there between that the weight stack cable 330 extends through. Rotation of the pelvic belt 320 clockwise (or to the right) from the position shown in FIG. 2 causes the cable 330 to abut the end 430 of the left arcuate roller support frame member 400 and pull the weights 280 up whereas rotation of the pelvic belt 320 counter-clockwise (or to the left) from the position shown in FIG. 2 causes the cable 330 to abut the end 440 of the central arcuate roller support frame member 410 and pull the weights 280 up. Thus, rotation of the pelvic belt 320 in a first range causes the weight stack cable 330 to slide along one of the opposing curved ends 430, 440 and rotation of the pelvic belt 320 in a second range causes the weight stack cable 330 to slide along an opposing one of the opposing curved ends 430, 440.

The pelvic belt 320 includes stationary left, central, and right abdominal pads 460, 470, 480 along a front interior of the pelvic belt 320. The pelvic belt 320 includes left and right adjustable main wings 490, 500 along a rear interior of the pelvic belt 320 with corresponding left and right adjustable main wing pads 510, 520. The left and right adjustable main wings 490, 500 are pivotally coupled near ends of the wings 490, 500 opposite of the pads 510, 520 to the left and right arcuate roller support frame members 400, 420. The left and right adjustable main wings 490, 500 may be automatically urged to the open position shown in FIG. 3A by spring mechanisms. A wing control cable 530 is coupled to the wings 490, 500 at a location between the pads 510, 520 and where the wings 490, 500 are pivotally coupled to the left and right arcuate roller support frame members 400, 420. Inner sections of the left, central, and right arcuate roller support frame members 400, 410, 420 include pulleys 540 that the wing control cable 530 runs through. At a portion of the wing control cable 530, just left of center, the wing control cable 530 runs in a serpentine manner through a wing control rotatable base 550 of a wing adjustment lever or adjustable wing control 560 to attach the wing control cable 530 to the wing control rotatable base 550. The wing control rotatable base 550 is rotatably coupled to the central arcuate roller support frame member 410. The wing adjustment lever 560 includes a substantially triangular extender 570 that is attached to the wing control rotatable base 550. A spring-loaded pull knob 580 is disposed at a distal end of the extender 570. A retractable pin of the spring-loaded pull knob 580 is selectively deployable within receiving holes 590 in adjustment plate 600, which is fixed to the central arcuate roller support frame member 410. A pelvic belt cover 610 (FIG. 3A) is attached to the top of the left, central, and right arcuate roller support frame members 400, 410, 420.

Figure 7:
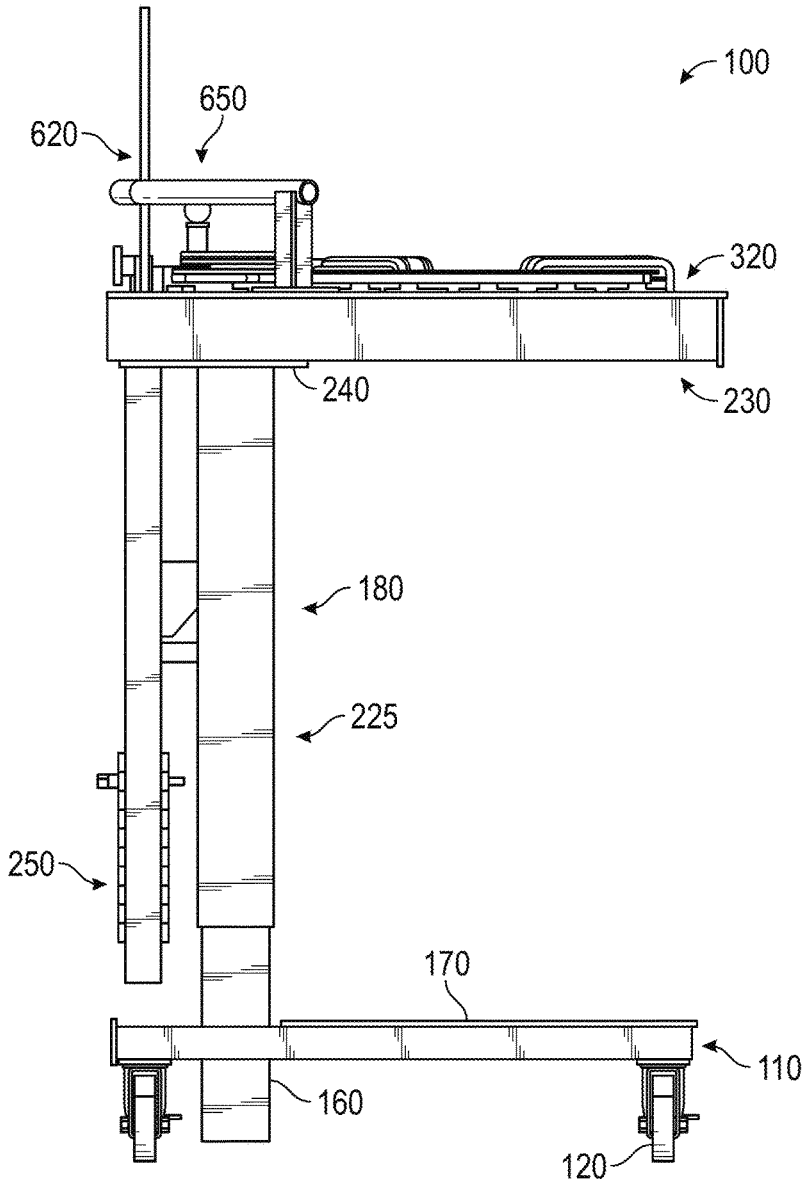
FIG. 7 is left side-elevational view of the torso muscle and spine exercise apparatus of FIG. 1.

To adjust the wings 490, 500 so as to secure the pelvic belt 320 around a user's pelvic area, similar to that shown in FIG. 7 of U.S. Pat. No. 6,368,296, which is incorporated by reference herein, a user enters the apparatus 100 from a rear of the apparatus 100 and steps onto the stationary standing plate 170 and enters into the pelvic belt 320 with the pelvic belt 320 in the open position shown in FIG. 3A. The user presses one's front firmly against the stationary left, central, and right abdominal pads 460, 470, 480, along a front interior of the pelvic belt 320. The user then pulls up on the spring-loaded pull knob 580, causing the pin to disengage from the prior selected receiving hole 590 of the adjustment plate 600, and moves the wing adjustment lever 560 to a position such as that shown in FIG. 3B, where the wings 490, 500 are secure against a rear of the user. The adjustment plate 600 serves as a stationary adjustment member with the holes forming various position settings and the spring-loaded pull knob 580 with movable pin serves as a movable/positionable pin adjustable wing control that is positionable in the position settings/holes for positioning and locking the adjustable wings 490, 500 in a desired position. With additional reference to FIG. 2, movement of the wing adjustment lever 560 towards the user, causes the wing control rotatable base 550 to rotate, which draws the opposite ends of the wing control cable 530 towards the front of the pelvic belt 320. This causes the wings 490, 500 to pivot forward, urging the left and right adjustable main wing pads 510, 520 against a rear of the user. When the wings 490, 500 are in a position where the pelvic belt 320 is snug and secure around the user, the user releases the spring-loaded pull knob 580, causing the pin to engage an underlying selected receiving hole 590 and the wing adjustment lever 560 to be locked in position in the adjustment plate 600.

The stationary pelvic belt receiving frame 230 includes a rotation limiter 620 centered laterally and vertically aligned with the single weight stack system 250, in a front portion 630 of the stationary pelvic belt receiving frame 230. The rotation limiter 620 includes a rotation limiter adjustment mechanism 622 (e.g., rotatable control knob with threads/receiving fastener/nut) that cooperates with a vertically adjustable rotation limiter movable member 624 having a rotation limiter stop member 626 on its lower end. To adjust the position of the rotation limiter 620, and, hence, the maximum degrees of rotation clockwise and counterclockwise by the pelvic belt 320, the rotation limiter adjustment mechanism 622 is rotated counter-clockwise, loosening the movable member 624, and the movable member 624 is slidably raised or lowered over the rotation limiter adjustment mechanism 622 to a desired vertical position to determine the maximum degrees of rotation clockwise and counterclockwise by the pelvic belt 320. The rotation limiter adjustment mechanism 622 is rotated clockwise, tightening/securing the movable member 624 into position once the movable member 624 is at the desired vertical location. The rotation limiter stop member 626 of the rotation limiter 620 stops rubber bumper 635 on top of weight stack support member 310 when rotation of the pelvic belt 320 reaches the pre-set range stops. The rotation limiter stop member 626 prevents the weight stack 280 from traveling further up, which limits how far the pelvic belt 320 can rotate in both the clockwise and counter clockwise directions. The weight stack 280 stops at the same degree of rotation in either direction.

The stationary pelvic belt receiving frame 230 includes a railing/handlebar assembly 650 along the front portion 630. The handlebar assembly 650 includes a straight central section 660 and angled left and right sections 670, 680. The handlebar assembly 650 is secured to a top surface 690 of the stationary pelvic belt receiving frame 230 via brackets 700 and fasteners. In use, a user grips the straight central section 660 or the angled left and right sections 670, 680 of the handlebar assembly 650. By gripping onto the handlebar assembly 650, the handlebar assembly 650 enables the user to keep one's upper torso substantially stationary while rotating the pelvic belt 320*a* with one's pelvic area.

Figure 8:
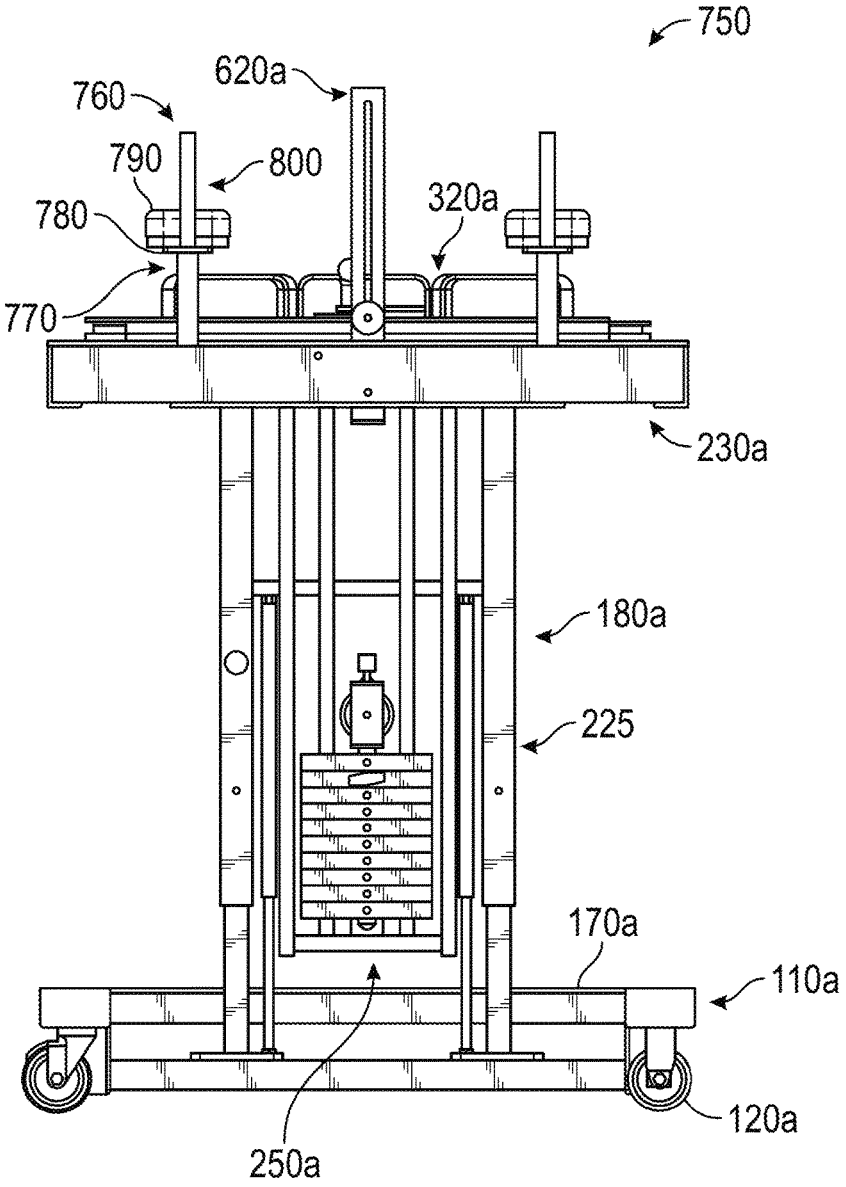
FIG. 8 is a front elevational view of another embodiment of a torso muscle and spine exercise apparatus including elbow supports instead of a railing, as shown in FIGS. 1-7.

With reference to FIG. 8, an alternative embodiment of a torso muscle and spine exercise apparatus ("apparatus") 750 is shown. Like elements to those shown and described for the apparatus 100 with respect to FIGS. 1-7, are shown with the same reference numbers, but with an "a" suffix. The apparatus 750 is similar to the apparatus 100, except the handlebar assembly 650 is replaced with a pair of raised handle and elbow pad assemblies 760. Each raised handle and elbow pad assembly 760 includes a support frame 770, a plate 780, an elbow pad 790, and a handle 800. In use, a user supports one's forearms and elbows on the elbow pads 790, while gripping the handles 800. By gripping onto the handles 800, the raised handle and elbow pad assemblies 760 enable the user to keep one's upper torso substantially stationary while rotating the pelvic belt 320*a* with one's pelvic area.

Figure 9:
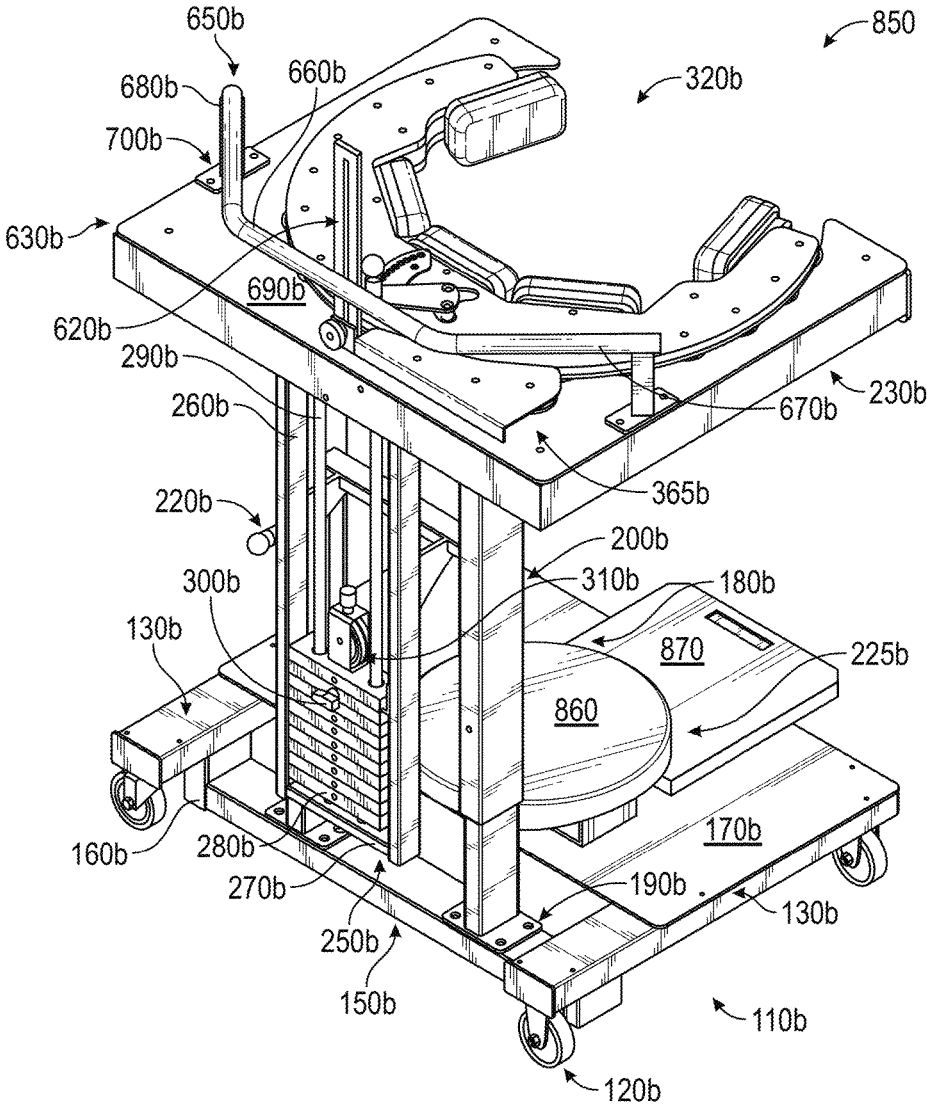
FIG. 9 is a perspective view of another embodiment of a torso muscle and spine exercise apparatus with a rotating plate and step.

With reference to FIG. 9, another embodiment of a torso muscle and spine exercise apparatus ("apparatus") 850 is shown. Like elements to those shown and described for the apparatus 100 with respect to FIGS. 1-7, are shown with the same reference numbers, but with a "b" suffix. The apparatus 850 is similar to the apparatus 100, except the apparatus 850 additionally includes a raised circular rotatable standing support or rotating plate 860 that is rotatably mounted to stationary standing plate 170. Maximum clockwise and counter clockwise degrees of rotation of the rotatable standing support 860 may be set by the rotation limiter 620 or by a different rotation limiter that operates in a similar manner (e.g., separate rotation limiter for a separate weight stack associated with the rotatable standing support 860). Behind the rotatable standing support 860 is a step plate or step 870 to assist the user in standing onto and off of the apparatus 850. Similar to the pelvic belt 320*b*, the rotatable standing support 860 is operably coupled to the weight stack 280 through a cable (not shown) and one or more pulleys (not shown) whereby clockwise and counter clockwise rotation of the rotatable standing support 860 causes the weight stack 280 to rise/lower, providing mechanical force resistance, similar to the operation of the pelvic belt 320 discussed above with respect to FIGS. 1-3B. In such operation, the pelvic belt 320*b* may be locked relative to the stationary pelvic belt receiving frame 230 such that the user's pelvic area and torso are stationary while only one's lower body and feet rotate clockwise and counter clockwise with/on the rotatable standing support 860. In an alternative embodiment, the rotatable standing support 860 may have its own separate weight stack system (see, for example, FIG. 10A), separate from and in addition to the weight stack system 250. In such an embodiment or a similar embodiment, the apparatus 850 may allow a user in the apparatus to rotate the pelvic belt 320*b* (with standing support 860 locked in stationary position), rotate the standing support 860 (with pelvic belt 320*b* locked in stationary position), and rotate both the pelvic belt 320*b* and the standing support 860 simultaneously.

Figure 10B:
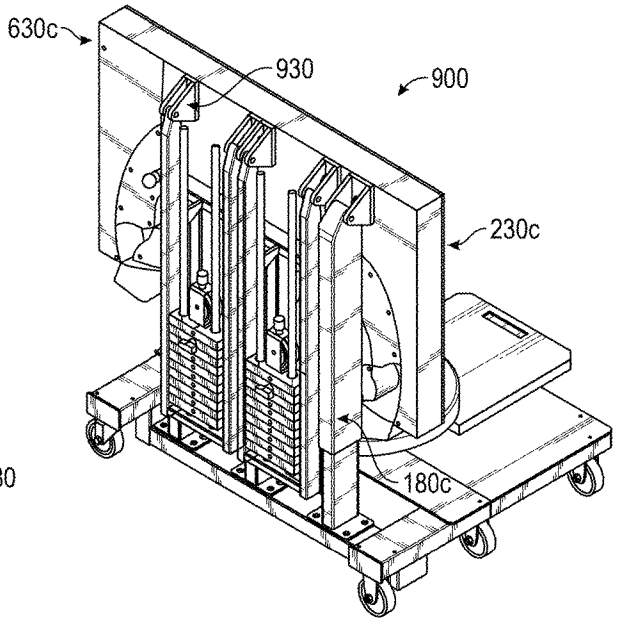
FIGS. 10A-10C are perspective views of a further embodiment of a torso muscle and spine exercise apparatus in which the apparatus is collapsible and expandable and includes collapsible wings, plate, and step.
Figure 10A:
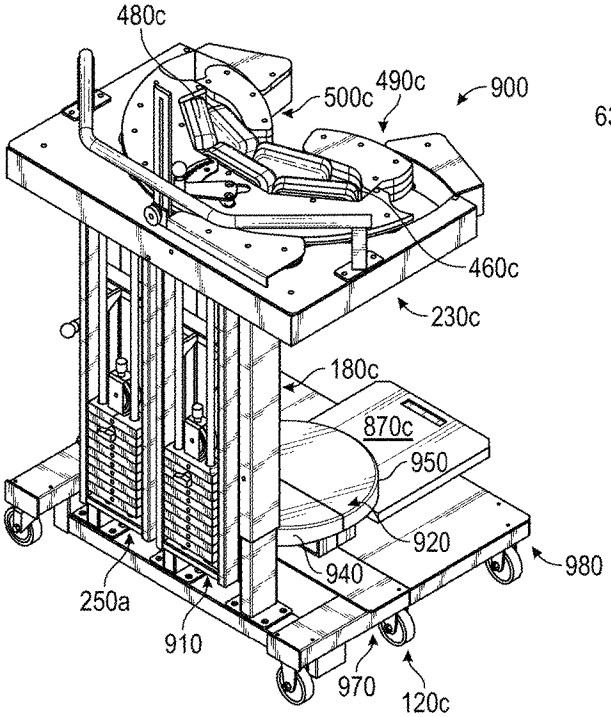
Figure 10C:
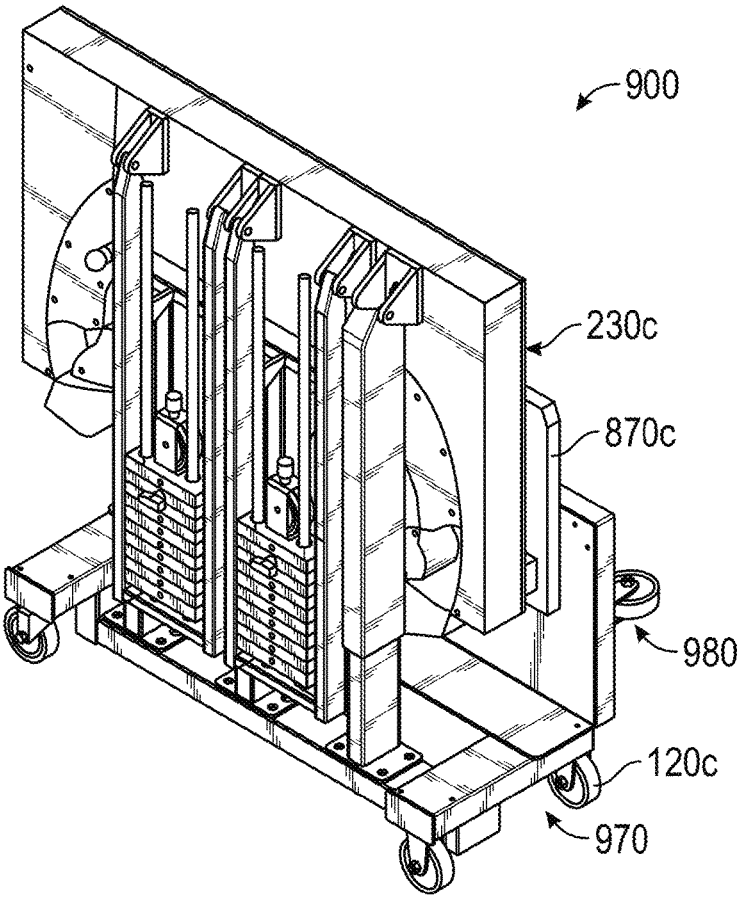

With reference to FIGS. 10A-10C, a further embodiment of a torso muscle and spine exercise apparatus ("apparatus") 900 is shown. Like elements to those shown and described for the apparatus 100 with respect to FIGS. 1-7, are shown with the same reference numbers, but with a "c" suffix. The apparatus 900 is a collapsible/foldable and expandable torso muscle and spine exercise apparatus. Such an apparatus 900 may be used, for example, but not by way of limitation, for home use where space restrictions in one's home may require one to fold/collapse the apparatus 900 when not in use and/or for storage/transport. The apparatus 900 is similar to the apparatus 850, except the apparatus 900 additionally includes a second weight stack system 910 operably coupled to raised circular rotatable standing support 920, the apparatus 900 includes an additional set of wheels 120*c*, and the apparatus 900 is foldable/collapsible as will now be described. Stationary pelvic belt receiving frame 230*c* pivots relative to vertical support columns 180*c* about pivot members 930, as shown in FIGS. 10A, 10B, to fold the pelvic belt receiving frame 230*c* down/up. The pivot members 930 are disposed along an underside of the front portion 630*c* of the pelvic belt receiving frame 230*c* and are pivotally coupled to a top of the vertical support columns 180*c*. As shown in FIG. 10A, left and right adjustable main wings 490*c*, 500*c* are pivotally mounted to the stationary pelvic belt receiving frame 230*c* for pivoting inward, adjacent to, and substantially parallel with the left and right abdominal pads 460*c*, 480*c*. Raised circular rotatable standing support 920 includes front and rear semi-circular members 940, 950 that are pivotally coupled to each other. Base 960 includes front and rear base members 970, 980 that are pivotally coupled to each other. As shown from FIGS. 10B to 10C, rear base member 980 (along with rear semi-circular member 950) pivots/folds up vertically relative to front base member 970 and front semi-circular member 940. In the configuration shown in FIG. 10C, the apparatus 900 is in an ideal configuration for storage/transport. The apparatus 900 may fold/pivot out to the configuration shown in FIG. 10A and the left and right adjustable main wings 490*c*, 500*c* may pivot out to the positions shown for adjustable main wings 490, 500 in FIG. 2.

Figure 11B:
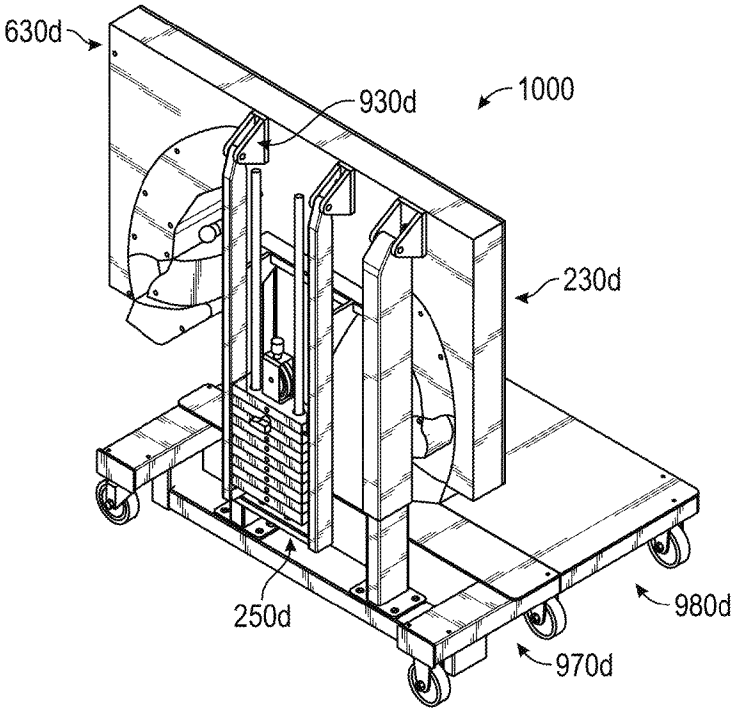
FIGS. 11A-11C are perspective views of a still further embodiment of a torso muscle and spine exercise apparatus in which the apparatus is collapsible and expandable and includes collapsible wings and base.
Figure 11A:
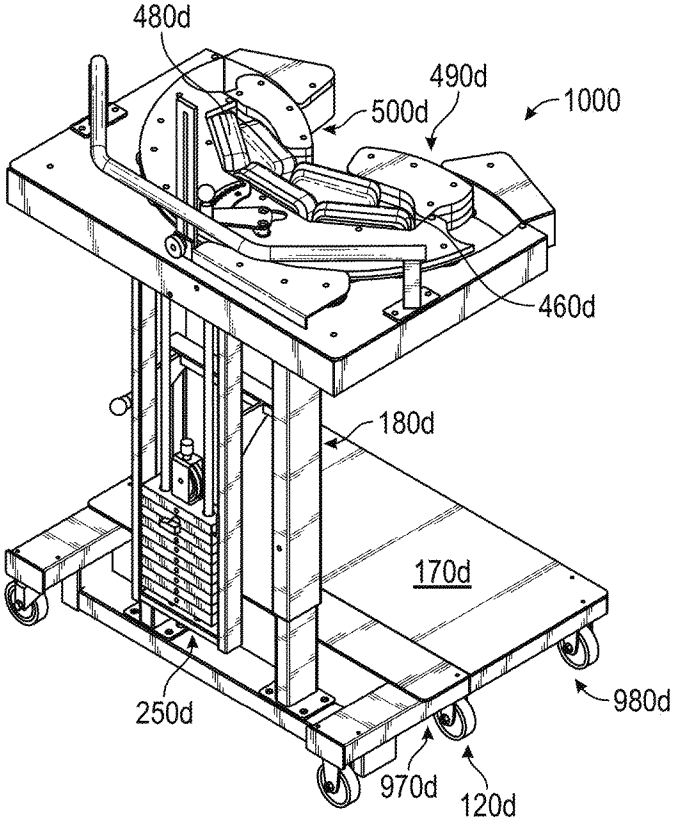
Figure 11C:
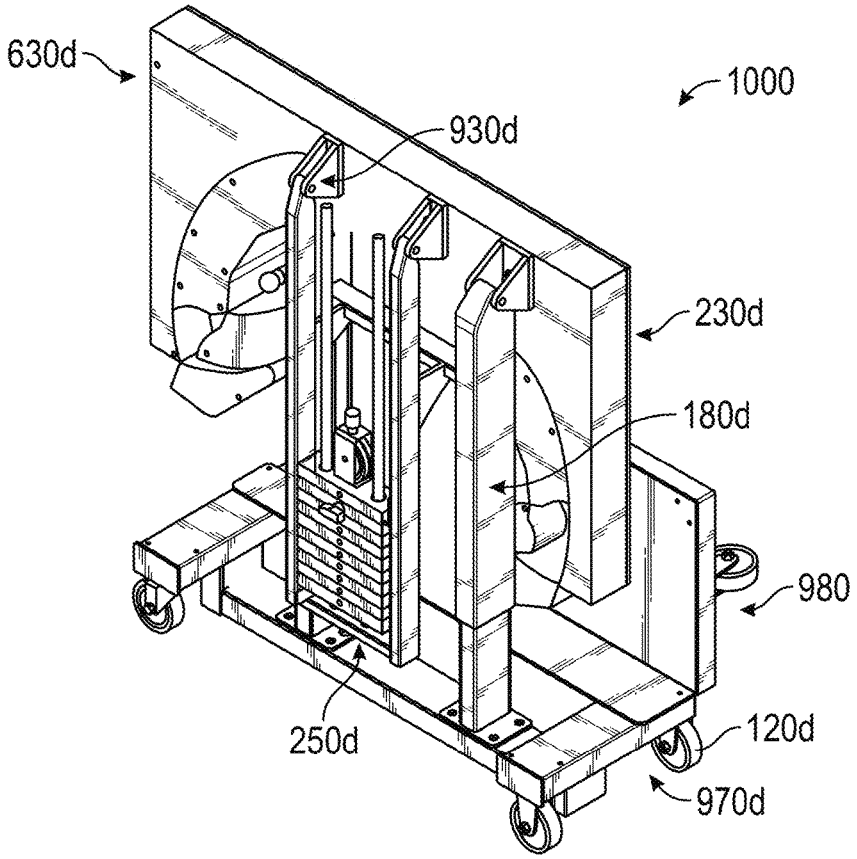

With reference to FIGS. 11A-11C, a still further embodiment of a torso muscle and spine exercise apparatus ("apparatus") 1000 is shown. Like elements to those shown and described for the apparatus 100 with respect to FIGS. 1-7 and apparatus 900, are shown with the same reference numbers, but with a "d" suffix. The apparatus 1000 is a collapsible/foldable and expandable torso muscle and spine exercise apparatus similar to the 900 shown with respect to FIGS. 10A-10C, except the apparatus 1000 includes only one weight stack, similar to the apparatus 100 shown and described with respect to FIGS. 1-7, and does not include the raised circular rotatable standing support 920.

Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in any following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, wherein the stationary pelvic belt receiving frame includes a front quadrant, a plurality of pulleys are disposed in the front quadrant, and the weight stack cable runs through the plurality of pulleys whereby rotation of the pelvic belt relative to the stationary pelvic belt receiving frame causes the coupled weights to raise and lower.

2. The exercise apparatus of claim 1, wherein the one or more mechanical force resistors include one of one of one or more weight stacks, one of one or more conventional coil springs, one of one or more elastomeric bands, one of one or more fluid springs, and one of one or more electromagnets.

3. The exercise apparatus of claim 2, wherein the single weight stack system includes a plurality of stacked weights and a weight stack cable coupled at one end to the stacked weights and coupled at an opposite end to the pelvic belt whereby rotation of the pelvic belt relative to the stationary pelvic belt receiving frame causes the coupled weights to raise and lower, depending on a direction of rotation and a degree of rotation.

4. The exercise apparatus of claim 1, wherein the exercise apparatus includes a front, and the one or more mechanical force resistors is a single weight stack system centered laterally at the front of the exercise apparatus, directly in front of where the user using the apparatus would stand on the supporting surface.

5. The exercise apparatus of claim 1, wherein the plurality of pulleys include a pair of adjacent horizontally disposed pulleys and a vertically disposed pulley disposed in a front central portion of the stationary pelvic belt receiving frame, and the weight stack cable runs laterally outward from the pelvic belt, through the horizontally disposed pulleys, and vertically downward through the vertically disposed pulley to the coupled weights.

6. The exercise apparatus of claim 5, wherein the pelvic belt includes left, central, and right arcuate roller support frame members that carry rollers, and the stationary pelvic belt receiving frame includes a roller receiving surface that the rollers of the pelvic belt engage to enable rotation of the pelvic belt relative to the stationary pelvic belt receiving frame.

7. The exercise apparatus of claim 1, further including a rotatable standing support to support a user's feet for rotation therewith, the one or more mechanical force resistors operably coupled to the rotatable standing support so as to impart resistance to rotation of the rotatable standing support.

8. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, wherein the pelvic belt includes left, central, and right arcuate roller support frame members that carry rollers, and the stationary pelvic belt receiving frame includes a roller receiving surface that the rollers of the pelvic belt engage to enable rotation of the pelvic belt relative to the stationary pelvic belt receiving frame, the left arcuate roller support frame member and the central arcuate roller support frame member include opposing curved ends with a gap there between that the weight stack cable extends through, and rotation of the pelvic belt in a first range causes the weight stack cable to slide along one of the opposing curved ends and rotation of the pelvic belt in a second range causes the weight stack cable to slide along an opposing one of the opposing curved ends.

9. The exercise apparatus of claim 1, wherein the pelvic belt includes a front interior and a rear interior, and the front interior includes one or more abdominal pads and the rear interior includes a pair of adjustable wings with pads thereon to secure a user's pelvic area on the pelvic belt.

10. The exercise apparatus of claim 9, wherein the pair of adjustable wings are pivotally coupled to the pelvic belt, and an adjustable wing control is operably coupled to the pair of adjustable wings to selectively adjust pivotal positioning of the pair of adjustable wings.

11. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, wherein the pelvic belt includes a front interior and a rear interior, and the front interior includes one or more abdominal pads and the rear interior includes a pair of adjustable wings with pads thereon to secure a user's pelvic area on the pelvic belt, the pair of adjustable wings are pivotally coupled to the pelvic belt, and an adjustable wing control is operably coupled to the pair of adjustable wings to selectively adjust pivotal positioning of the pair of adjustable wings, and the pelvic belt includes pulleys and a wing control cable running through the pulleys, the wing control cable operably coupling the adjustable wing control to the pair of adjustable wings through the pulleys to selectively adjust pivotal positioning of the pair of adjustable wings.

12. The exercise apparatus of claim 11, wherein the adjustable wing control includes a wing control rotatable base that the wing control cable is disposed within whereby rotation of the wing control rotatable base caused by operation of the adjustable wing control causes an effective length of the wing control cable to shorten or lengthen, depending on direction of rotation of the wing control rotatable base, causing the pair of adjustable wings to close or open.

13. The exercise apparatus of claim 12, wherein the pelvic belt includes a stationary adjustment member with position settings and the adjustable wing control is positionable in the position settings for positioning and locking the adjustable wings in a desired position.

14. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, wherein in an operational configuration the stationary pelvic belt receiving frame, the pelvic belt, and the base are horizontally disposed and the support frame is vertically disposed, and in a collapsed configuration the pelvic belt receiving frame, the pelvic belt, the base, and the support frame are vertically disposed.

15. The exercise apparatus of claim 14, wherein the pelvic belt receiving frame is pivotally coupled to the support frame, the base is a collapsible base including front and rear base members that are pivotally coupled to each other, and in the collapsed configuration, the pelvic belt receiving frame is pivoted downward with respect to the support frame, and the rear base member is pivoted upward with respect to the front base member.

16. The exercise apparatus of claim 15, wherein the pelvic belt includes a front interior and a rear interior, and the front interior includes one or more abdominal pads and the rear interior includes a pair of adjustable wings with pads thereon to secure a user's pelvic area on the pelvic belt, the pair of adjustable wings are pivotally coupled to the pelvic belt so as to pivot inward, adjacent to, and substantially parallel with the left and right abdominal pads.

17. The exercise apparatus of claim 15, further including a collapsible rotatable standing support to support a user's feet for rotation therewith, the one or more mechanical force resistors operably coupled to the rotatable standing support so as to impart resistance to rotation of the rotatable standing support, the rotatable standing support including front and rear semi-circular members that are pivotally coupled to each other so as pivot onto each other to collapse the rotatable standing support, and in the collapsed configuration, the rear base member and the collapsible rotatable standing support are pivoted upward with respect to the front base member.

18. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, wherein the support frame includes a pair of vertical support columns with height adjustment holes, a spring-loaded height adjustment mechanism that cooperates with the height adjustment holes, and a pair of gas-charged struts that counter-balance the weight of the stationary pelvic belt receiving frame and the support frame to easily lower and raise the pair of vertical support columns to a desirable height for a user.

19. An exercise apparatus, comprising:

a base;

a supporting surface carried by the base, the supporting surface to receive a weight bearing portion of a user's body;

a support frame carried by the base;

a stationary pelvic belt receiving frame carried by the support frame;

a pelvic belt rotatably received within the stationary pelvic belt receiving frame and configured to securely receive a pelvic area of the user's body for rotation therewith;

one or more mechanical force resistors carried by the support frame and operably coupled to the pelvic belt so as to impart resistance to rotation of the pelvic belt relative to the stationary pelvic belt receiving frame, a rotation limiter having a vertically adjustable rotation limiter movable member and a rotation limiter adjustment mechanism that cooperates with the vertically adjustable rotation limiter movable member to adjust a vertical position of the vertically adjustable rotation limiter movable member, which is operably associated with the one or more mechanical force resistors to limit maximum degrees of rotation clockwise and counter-clockwise by the pelvic belt.

* * * * *